United States Patent [19]

Schwab

[11] 4,120,188

[45] Oct. 17, 1978

[54] BLIND RIVETER

[75] Inventor: Manfred Schwab, Wiesbaden, Fed. Rep. of Germany

[73] Assignee: Fa Alfred Hansel, Nieten-Und Metallwarenfabrik, Ruhr, Fed. Rep. of Germany

[21] Appl. No.: 717,492

[22] Filed: Aug. 25, 1976

[30] Foreign Application Priority Data

Aug. 25, 1975 [DE] Fed. Rep. of Germany ..... 2537794

[51] Int. Cl.[2] ..... B21J 15/34

[52] U.S. Cl. ..... 72/391; 72/453.17

[58] Field of Search ..... 72/391, 453.17; 29/243.53

[56] References Cited

U.S. PATENT DOCUMENTS

| | | | |
|---|---|---|---|
| 3,082,898 | 3/1963 | Bosch | 72/453.17 |
| 3,254,522 | 6/1966 | Elliott | 72/391 |
| 3,328,985 | 7/1967 | Keymer | 72/391 |
| 3,457,763 | 7/1969 | Freeman | 72/453.17 |
| 3,768,297 | 10/1973 | Martin | 72/391 |

FOREIGN PATENT DOCUMENTS

| | | | |
|---|---|---|---|
| 2,028,725 | 6/1970 | Fed. Rep. of Germany | 72/391 |
| 2,264,780 | 7/1975 | Fed. Rep. of Germany | 72/391 |

*Primary Examiner*—C.W. Lanham
*Assistant Examiner*—Gene P. Crosby
*Attorney, Agent, or Firm*—Christie, Parker & Hale

[57] ABSTRACT

A blind riveter comprises chuck jaws for clamping a tension shaft of a blind rivet and a longitudinally movable tension chuck for moving the chuck jaws radially relative to the tension shaft for clamping and releasing the tension shaft as the tension shaft longitudinally moves in relation to the chuck jaws back and forth from a charging position into a tension position. As the tension shaft longitudinally moves, the chuck jaws and a clamped tension shaft are carried along until reaching a tear off position of the tension shaft. A step face is pressed against the chuck jaws by a loaded spring for pressing the chuck jaws into the charging position. A loaded return spring presses the tension chuck into the charging position. Means for moving the tension chuck against the force of the return spring is provided. The charging position of the tension chuck can be shifted with an adjustable abutment for the return spring, where the position of the abutment is adjusted to vary the load of the return spring. Alternatively the charging position of the tension chuck is shifted by means of a stop face for a shoulder of the chuck jaws, where the stop face is mountable in at least two longitudinally spaced apart positions in the casing of the blind riveter.

3 Claims, 2 Drawing Figures

BLIND RIVETER

BACKGROUND

This invention concerns a blind riveter with chuck jaws for gripping of a blind rivet tension shaft, and a tension chuck for moving the chuck jaws radially relative to the tension shaft for clamping and releasing the shaft as the tension chuck moves in relation to the chuck jaws back and forth from a charging position into a tension position. As well when the tension shaft is clamped by the chuck jaws, the tension chuck is longitudinally movable until reaching the tear off position of the tension shaft.

The insertion of the blind rivet tension shaft between the chuck jaws should be, due to reasons of accelerative work, rapid and possible without any large expenditure of power. On the other hand, it is desirable that the chuck jaws retain the inserted tension shaft far enough so that when the blind riveter is placed in a unfavorable working position the blind rivet does not fall out.

The task of the invention is to develop by simple means a blind riveter of the previous described type which aperture of the chuck jaws in the charging position is accordingly adjustable to the intended thickness of the tension shaft and the working position of the implement, and only after change of the circumstances must be regulated.

SUMMARY

The task is accomplished through the arrangement of a shift in the charging position in the direction of movement of the tension chuck. The clamping effect of the chuck jaws is determined through the relative position between the tension chuck and chuck jaws in the charging position. The farther the tension chuck reaches over the chuck jaws, the smaller is their momentary clamping effect. Thus the tension shaft is easier to insert. It can however under circumstances fall out the bottom. Should the tension chuck reach over only a portion of the chuck jaws, the chuck jaws would become clamped more forcedly. Thus, the tension shaft is more difficult to insert against clamping force, nevertheless, is retained even when the aperture of the blind riveter is held in a downward manner. The arrangement must limit to the desired degree the relative motion between the tension chuck and the chuck jaws.

An advantageous arrangement for the shifting of the charging position comprises an element with a stop face for the chuck jaws in their clamping position, the chuck jaws being pressed against the stop face by a loaded spring, a pressure medium for the power stroke movement of the tension chuck into tension in the tear off direction, a direct or indirect return set spring attached to the tension chuck for the return motion of the tension chuck into the charging position, and an adjustable abutment for the return set spring. When the power stroke of the tension chuck is effected by a pressure medium, such as by a piston coupled thereto, an equalization between the pressure medium in a pertinent cylinder and the resistance of the tension spring results, which prevents the farther movement of the chuck from the charging position. The return movement of the chuck into the charging position is accomplished by the return set spring, which tension determines the charging position. Under higher pre-tension the return set spring pushes the tension chuck against its stop face. In this position the tension chuck reaches over the chuck jaws so far that they are open, i.e., exert no clamping effect on the pushed in tension shaft. Should the abutment be adjusted to the extent that the return set spring is not pre-tensioned, then it will not effect any return set force on the tension chuck, which remains in the previously described position at the end of the pressure discharge. In this position it reaches over the chuck jaws only far enough that the jaws are only slightly looser than in the tear off clamping position. The tension shaft, with the expenditure of power against the spring of the chuck jaws, becomes pushed inward and is immediately held securely thereby. Intermediate positions of the abutment have, as a result of the chuck jaws, intermediate positions and intermediate clamping effects. The selected charging position, adjusted by the abutment, remains constant long enough for the complete riveting procedure, until a change is necessary or desired and the regulation of the abutment can take place.

In the preferred design, a thread and a counter threaded abutment having a handle for turning are arranged in the spring housing. Not only does the screw construction of the abutment make a simple manipulation possible, it also makes a variable and very accurate adjustment of the charging position possible.

The essential thought of the invention, to change the clamping effect through a change of the return course of the tension chuck, is possible via other means. For example, the tension chuck can have at least a shoulder, and a stop face for the shoulder mountable in at least two places in the casing.

An insert providing a stop face for the shoulder is thereby to be mounted in a place where it does not prevent the power stroke of the tension chuck. An adjustable stop face does not allow the same variable adjustment as the screwable abutment, it however guarantees the selected charging position is independent of the circumstances in the cylinder of the pressure medium.

DRAWINGS

An example of the design of the invention is represented in the drawings. Shown are:

DESCRIPTION

Figure 1:
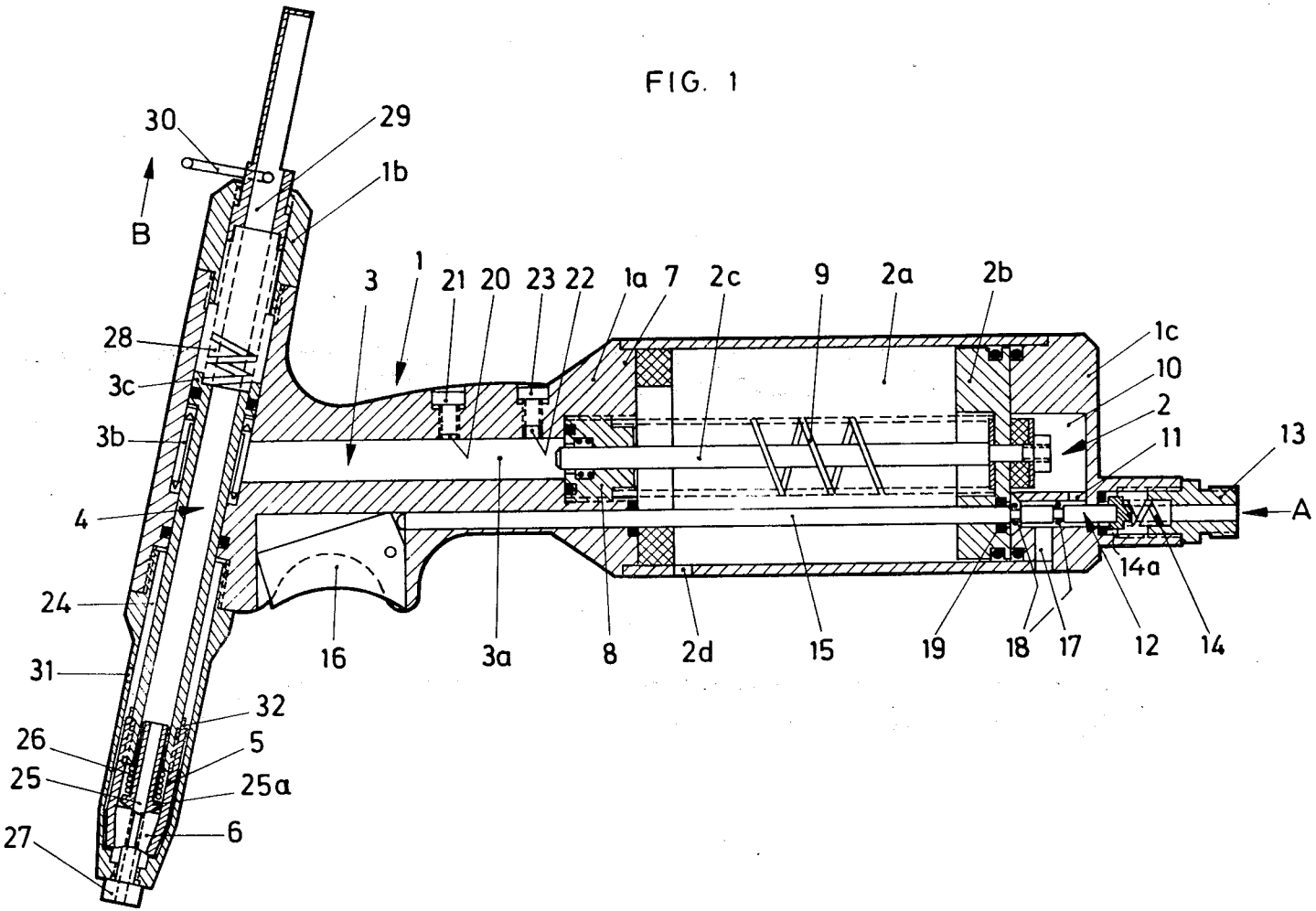
FIG. 1 is a section drawing of the blind riveter; ad

The blind riveter represented in FIG. 1 has a casing 1 with an operational component 1*a*, and a working component 1*b* which extends almost vertical to the operational component. In the operational component 1*a* is a complete unit accommodated, comprising a pneumatic system designated with 2 and the most essential elements of a hydraulic system designated with 3. The working component 1*b* contains a mechanism for motion 4 for a chuck 5 with chuck jaws 6.

The pneumatic system has a cylinder 2*a*, which wall for the most part is constructed from the operational component 1*a* of the casing. A longitudinal sliding piston 2*b* is arranged in cylinder 2*a*. The face of the piston towards the region of the end of the casing is hittable with compressed air. A piston rod 2*c* is attached centrally to the face of the piston and is axially aligned with the cylinder. The front wall 7 of the cylinder 2*a* opposite the piston is continuous with the casing in one piece and contains centrally a sealing unit 8, wherethrough the piston rod 2*c* penetrates centrally. Its end projects into a hydraulic tube 3*a* which diameter exceeds that of the piston rod 2c, which however amounts to less than the diameter of the cylinder 2a of the pneumatic system. Further, a coil spring 9 is mounted in a cylinder 2a of the pneumatic system which in a resting position loads the piston 2b in a direction toward the end of the casing 1c, near the end of the cylinder. The casing 1, in its end region 1c, forms a chamber 10 with an aperture to the cylinder 2a, which is covered by the piston when in its resting position, and with an inlet aperture 11 to a valvular system, which as a complete unit is designated with 12. Thereto belongs a connecting piece 13 for a compressed air line, not shown, a spring loaded inlet valve 14, a valve tappet 15, which by means of a handle 16 is axially movable against the inlet valve which opens against pressure of its spring, as well as an exit aperture 17 in the end region of the casing 1c, and two ring seals 18 working together with the outlet aperture, arranged around the valve tappet with spacing therebetween.

The valve tappet 15 penetrates through the cylinder 2a parallel to piston rod 2c, whereby one end projects into the valvular system in the described manner, and the other end protrudingly arranged, longitudinally sliding, through the front wall 7 and there butts against the swivelable arranged handle 16. Further, the valve tappet 15 penetrates a sealed sealing ring 19, and the piston 2b, whereby the valve tappet and the piston are reciprocally longitudinally slidable.

The hydraulic system 3 has, in the region of the casing 1a, a filling aperture 20 opening into the hydraulic tube 3a with a lock screw 21 and neighboring thereby a ventilation aperture 22 with a lock screw 23. The ventilation aperture 22 opens in a region of the casing 1 toward the outside, which is slightly thicker than the region where the filling aperture 20 opens.

The hydraulic tube 3a opens into a hydraulic cylinder 3b which wall essentially belongs to the working component 1b of the casing. A ring shaped piston 3c is arranged there in a slidable manner. It is connected in one piece together with a tube 24, which on its end farthest from the piston is screwed firmly together with a chuck 5. The chuck 5 conically shaped on its free end, inside and out, encloses chuck jaws 6 which are as well conically designed. A fastener 25 with an essentially tube shaped body is arranged with one end longitudinally slideable in the tube 24, the other end has a rotating conical flange 25a on the front side serving as a stop face for the chuck jaws 6. The flange 25a pushes against the chuck jaws 6 and is loaded by the compression spring 26, which props on the reverse side of the flange 25a, and again against the front surface of the tube 24. The free ends of chuck jaws 6 are propped against a nozzle 27, which is attached in the casing.

A return spring 28 touches the opposite side of the hydraulic piston 3c of the hydraulic cylinder. The other end rests against an abutment 29 which is screwed into the casing 1b in a longitudinally adjustable manner. The handle 30 is intended for adjustments.

A viewing window 31 in the configuration of a small opening is intended in the working component casing 1b, roughly in the middle between the working end of the working component 1b and the end of the cylinder faced thereto. In the general region of the connection between the tension chuck 5 and the tube 24 a ring shaped marking 32 in an eye catching color is to be applied to the tube 24.

The mode of operation of the described blind riveter is as follows: The FIG. 1 shows the resting position, in which the air pressure valve 14 is closed by its spring, the piston 2b of the pneumatic system is held in position near the end of the casing 1c by a coil spring 9, and the piston 3c of the hydraulic installation is being pushed in the direction of the working end of the working component 1b of the casing by the return spring 28.

Depending upon the initial tension of the return spring 28 by the abutment 29, the chuck 5 is pushed over chuck jaws 6 and presses these more or less together. You can in this manner hold an inserted tension shaft of a blind rivet. In such an event, this must be inserted against the strength of the compression spring 26. As the blind rivet is inserted into the intended opening, on which edge the nozzle 7 props, the handle 16 is swiveled. Thereby, it pressures the valve tappet 15 against the spring loaded inlet valve 14 so that this opens by moving from its valve seat 14a.

Compressed air can reach via the direction of arrow A through the inlet aperture 11 into the chamber 10 behind the pneumatic piston 2b. With the sliding of the valve tappet 15 both ring seals 18 arrive at the position on both sides of the exit aperture 17, so that the compressed air of chamber 10 cannot reach the outlet aperture. It pushes the piston 2b, on the contrary, against the force of the coil spring 9 in such a manner that the piston rod 2c plunges into the hydraulic tube 3a. In this manner, the pressure in the closed hydraulic system 3 increases. Through the increased pressure, the ring piston 3c is pushed against the return spring 28 in the direction of the arrow B. Automatically, tube 24 transfers this motion to the chuck 5. This on one hand takes the chuck jaws 6 with it, whereby the conical surfaces are compressed together even more, since chuck jaws cannot follow immediately due to the friction of motion with the tension shaft of a blind rivet. By the further course of the piston stroke the chuck jaws are carried along and transfer the tension to the tension shaft which, on the other hand, in the known manner deforms the rivet head and finally tears away at the intended breaking off site. The torn off shaft-end can reach the outside of the casing of the implement through the axial aligned bore holes of the chuck jaws, of the fasteners, of the tube 24 and finally as well of the tube shaped abutment 29.

As soon as the person operating the implement perceives the jolt under the tearing off of the tension shaft and releases the handle 16, valve 14 closes by its spring, during which the valve tappet moves back to the starting position. Thereby, air can pass through an outlet aperture 2d into the cylinder directly from the outside, and compressed air can pass out of chamber 10, which has become larger through the stroke of the piston, sideways around the protruding portion of the valve tappet in this chamber to flow outside through the outlet aperture 17. Piston 2b is moved to its resting position by coil spring 9. Simultaneously with the reduction of pressure in the hydraulic tube 3a, the return spring 28 moves the piston 3c back into the charging position.

The charging position of the tension chuck changes depending on the pre-position which the return spring 28 receives through the positioning of its abutment 29. Upon higher tension of the return spring 28 the tension chuck 5 completely reaches over the chuck jaws 6. The conical design on both sides results in an open position of the tension jaw. Upon a completely released return spring 28, the tension chuck encloses the chuck jaws only partially and thereupon places an effect of tension on the chuck jaws which is transferred as a clamping effect to the inserted blind rivet tension shaft.

Figure 2:
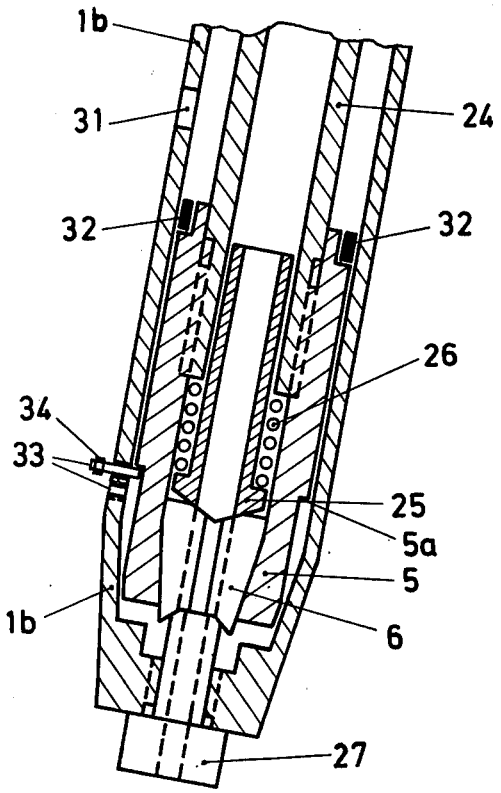
FIG. 2 is an enlargement of details of another form of design.

FIG. 2 shows an enlargement of a blind riveter in the region of the chuck jaw of another form of design. The charging position of the tension chuck is regulated thereby, that the tension chuck is designed with a ring shoulder 5*a* in which region it does not rest against the inside wall of the casing 1*b*. The casing 1*b* is provided with two threaded bore holes 33 in an interval-arrangement one above the other. A stop face or insert 34 can be screwed into the threaded bore holes 33. In FIG. 2, the insert 34 is inserted into the superior threaded bore hole. It works together with the ring shoulder 5*a* of the tension chuck in such a manner, that the insert 34 limits the tension chuck's return set motion so that it does not continue to the possible terminal position.

In the charging position represented, the tension chuck 5 exerts radially tension force on chuck jaws 6 through which the tension jaws 6 immediately hold an inserted blind rivet tension shaft clamped against the force of spring 26.

What is claimed is:

1. In a blind riveter comprising chuck jaws for clamping a tension shaft of a blind rivet, a longitudinally movable tension chuck for moving the chuck jaws radially relative to the tension shaft for clamping and releasing the tension shaft as the tension chuck longitudinally moves in relationship to the chuck jaws back and forth from a charging position into a tension position, the charging position being for insertion of the tension shaft of a blind rivet into the chuck jaws and the tension position being for applying tension to the tension shaft of the blind rivet, wherein as the tension shaft longitudinally moves, the chuck jaws and a clamped tension shaft are carried along until reaching a tear off position of the tension shaft, a stop face being pressed against the chuck jaws by a loaded spring for pressing the chuck jaws into the charging position, a loaded return spring for pressing the tension chuck into the charging position, and means for moving the tension chuck against the force of the return spring, the improvement comprising an adjustable abutment for the return spring, wherein the position of the abutment is adjustable to vary the load of the return spring for shifting the charging position of the tension chuck.

2. The blind riveter of claim 1 in which the return spring is mounted in an internally threaded casing, and wherein the abutment is counter-threaded and has a handle for turning the abutment to adjust the position of the abutment in the casing.

3. In a blind riveter comprising a casing;

chuck jaws in the casing for clamping a tension shaft of a blind rivet, a longitudinally movable tension chuck in the casing for moving the chuck jaws radially relative to the tension shaft for clamping and releasing the tension shaft as the tension chuck longitudinally moves in relationship to the chuck jaws back and forth from a charging position into a tension position, the charging positions being for insertion of the tension shaft of a blind rivet into the chuck jaws and the tension position being for applying tension to the tension shaft of the blind rivet, wherein as the tension shaft longitudinally moves, the chuck jaws and a clamped tension shaft are carried along until reaching a tear off position of the tension shaft, a stop face being pressed against the chuck jaws by a loaded spring for pressing the chuck jaws into the charging position, a loaded return spring for pressing the tension chuck into the charging position, and means for moving the tension chuck against the force of the return spring, the improvement comprising means for adjusting the loading of the return spring, the loading of the return spring determining the charging position of the tension chuck.

* * * * *

UNITED STATES PATENT AND TRADEMARK OFFICE

CERTIFICATE OF CORRECTION

PATENT NO. : 4,120,188

DATED : Oct. 17, 1978

INVENTOR(S) : Manfred Schwab

It is certified that error appears in the above-identified patent and that said Letters Patent are hereby corrected as shown below:

Assignee should be Fa Alfred Honsel and not
Fa Alfred Hansel

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*